US007062794B2

(12) United States Patent
LeBlanc

(10) Patent No.: US 7,062,794 B2
(45) Date of Patent: Jun. 20, 2006

(54) COMBINATION WAIST BELT AND MUSICAL INSTRUMENT STRAP

(76) Inventor: Byron LeBlanc, 1171 Breaux Bridge Sr. High Rd., Breaux Bridge, LA (US) 70517-8312

( * ) Notice: Subject to any disclaimer, the term of this patent is extended or adjusted under 35 U.S.C. 154(b) by 93 days.

(21) Appl. No.: 10/847,269

(22) Filed: May 17, 2004

(65) Prior Publication Data

US 2005/0251897 A1 Nov. 17, 2005

(51) Int. Cl.
*A41F 9/00* (2006.01)
*G10D 3/00* (2006.01)

(52) U.S. Cl. ..... 2/312; 84/327; 224/268

(58) Field of Classification Search ..... 2/310–322, 2/1, 327, 328, 329, 338; 84/280, 281, 327, 84/421; 224/265, 268, 910
See application file for complete search history.

(56) References Cited

U.S. PATENT DOCUMENTS

| | | | | |
|---|---|---|---|---|
| 596,849 | A | 1/1898 | Combier | |
| 1,345,750 | A | 7/1920 | De Beaumont | |
| 2,641,812 | A | 6/1953 | Boudreau | |
| 2,643,039 | A * | 6/1953 | Sottile | 224/614 |
| 2,885,685 | A | 5/1959 | Carr | |
| 3,894,464 | A * | 7/1975 | Brooks | 84/327 |
| D253,258 | S | 10/1979 | Clark | |
| 4,173,794 | A | 11/1979 | Nichols | |
| D255,061 | S | 5/1980 | Nichols | |
| D286,581 | S | 11/1986 | Panth | |
| 5,069,103 | A * | 12/1991 | Healy | 84/327 |
| 5,519,893 | A | 5/1996 | Silver | |
| 5,616,874 | A | 4/1997 | Kraus | |
| 5,772,091 | A * | 6/1998 | Lackner | 224/265 |
| 5,797,171 | A | 8/1998 | Nelson | |
| 5,983,403 | A | 11/1999 | Neeley | |
| 5,988,474 | A | 11/1999 | Smith, II | |
| 6,040,509 | A * | 3/2000 | Fanella | 84/280 |
| 6,359,203 | B1 * | 3/2002 | Cronos | 84/327 |
| 6,371,346 | B1 | 4/2002 | Sharma | |

FOREIGN PATENT DOCUMENTS

| | | |
|---|---|---|
| EP | 485733 | 5/1992 |

* cited by examiner

*Primary Examiner*—Tejash Patel
(74) *Attorney, Agent, or Firm*—Juan J. Lizarraga

(57) ABSTRACT

A device for serving interchangeably as a waist belt and a strap for a musical instrument composed of a flexible elongated member of sufficient length to support a musical instrument on the shoulder of a musician and yet adaptable and wearable as a waist belt with extra length of the elongated member concealed. The elongated member has integral strap apertures on left and right ends for placement on strap buttons of a musical instrument. The elongated member also has integral belt apertures on the middle portion between the right and left ends for attachment to one end of the elongated member by means of an attachment belt hook affixed to that end when the device is worn as a waist belt normally used to support a garment such as pants with belt loops.

17 Claims, 8 Drawing Sheets

COMBINATION WAIST BELT AND MUSICAL INSTRUMENT STRAP

The present invention relates to a combination device which can be worn as a waist belt or used as a strap for a musical instrument such as a guitar.

BACKGROUND OF THE INVENTION

Many string musical instruments such as the electric guitar, acoustic guitar, bass, banjo, and mandolin can be played while standing. Likewise, older instruments such as the dulcimer and the lap harp can be played while standing. This is also true of other types of instruments such as the saxophone. The one thing all these instruments require for such performance is a strap to support the instrument while being played. The strap transfers the weight of the instrument to the shoulders and upper torso of the musician thereby freeing the hands to play the instrument.

Instruments which can be played with a strap are normally fitted with protrusions or pegs at either end to receive the ends of a strap. On guitars these pegs are commonly known as "strap buttons" meant to slip through a slotted hole on each end of the strap. Numerous straps of many different materials and styles are available to suit the taste of the individual musician but they are all designed to do one thing, and that is to support the instrument while being played. Because straps are easily removed and attached to an instrument, it is possible and does happen that a strap may not be stored with the instrument itself in the instrument case. Therefore, there are occasions when a musician may arrive to play a musical engagement without a strap.

There is one item of apparel which most people always have and that is a waist belt. Unfortunately, a musician in need of an instrument strap cannot use a waist belt as a substitute instrument strap for several reasons, not the least of which is that a waist belt is generally shorter than an instrument strap. A second reason is that a waist belt does not have the attachments necessary to connect to a musical instrument. In addition to these reasons, a normal waist belt also has a buckle and other hardware which would scratch and scar an expensive musical instrument if the waist belt could be used.

SUMMARY OF THE INVENTION

Accordingly, it is an object of the present invention to provide a combination device which will serve interchangeably as a waist belt and a strap for a musical instrument.

It is an object of the present invention to provide a device of sufficient length to support a musical instrument on the shoulder or upper torso of a musician with suitable attachment means on the device to attach the ends of the device to the musical instrument.

It is another object of the present invention to provide a device which can be readily worn as a waist belt on pants or other garment.

It is another object of the present invention that it have no buckle or other attachment hardware or ornamentation which could scratch or mar the surface of a musical instrument.

More specifically, the present invention comprises an elongated flexible belt of sufficient length to serve as a musical instrument strap having a right end, a left end, a middle portion, an outer surface and an inner surface, said right end and left end each having attachment means for attachment to a musical instrument, one of said ends having an attachment belt hook, said middle portion having receiving means for through placement of said belt hook when said device is worn as a waist belt.

In a preferred embodiment of the present invention, the attachment means further comprises an end having a plurality of integral strap apertures extending between the outer surface and inner surface for attachment to a musical instrument fitted with strap buttons and the receiving means further comprise the middle portion having a plurality of integral belt apertures extending between the outer surface and inner surface for selective through insertion of the belt hook when said device is worn as a waist belt.

In an alternative embodiment, the attachment belt hook on one of said ends further comprises a head with a top head surface and a bottom head surface, said bottom head surface adjacent to the outer surface, at least one locking tab on bottom head surface, said locking tab impinging on the outer surface, a shank extending from the bottom head surface through the belt and extending beyond the bottom surface, and a retaining washer over the shank at the inner surface. It is also an object of the invention that the attachment belt hook be made from a non-scratching material of non-metallic composition.

It is also intended that the shank be bent in a direction away from the end where the attachment belt hook is affixed.

It is also intended that the head and shank of the attachment belt hook can be integrally manufactured as one by a suitable manufacturing process such as casting or injection molding.

It is also an object of this invention to provide a method for manufacturing a combination waist belt and musical instrument strap device, by (a) providing an elongated flexible belt of sufficient length to serve as a musical instrument strap having a right end, a left end, a middle portion, an outer surface and an inner surface; (b) providing attachment means at the right end and left end for attachment to a musical instrument; (c) providing an attachment belt hook at one of said ends; and (d) providing receiving means in the middle portion for through placement of the attachment belt hook when the device is worn as a waist belt.

This method further comprises the step of providing attachment means at each end comprising at least one integral strap aperture extending between the outer surface and inner surface for attachment to a musical instrument fitted with strap buttons.

This method further comprises the step of providing receiving means in the middle portion comprising at least one integral belt aperture extending between the outer surface and inner surface for selective through insertion of the belt hook when said device is worn as a waist belt.

This method further comprises the step of providing an attachment belt hook at one of the ends wherein the attachment belt hook comprises a head with a top head surface and a bottom head surface adjacent to the outer surface, at least one locking tab on bottom head surface, said locking tab impinging on the outer surface, a shank attached to the bottom head surface and extending from the bottom head surface through the elongated flexible belt and extending beyond the bottom surface, and a retaining washer over the shank at the inner surface.

This method also comprises the step of providing a shank which is bent in a direction away from the end of the elongated flexible belt where the attachment belt hook is affixed.

This method also comprises the step of providing an attachment belt hook where the head and shank are integrally manufactured of non-metallic material.

DETAILED DESCRIPTION OF THE INVENTION

Figure 1:
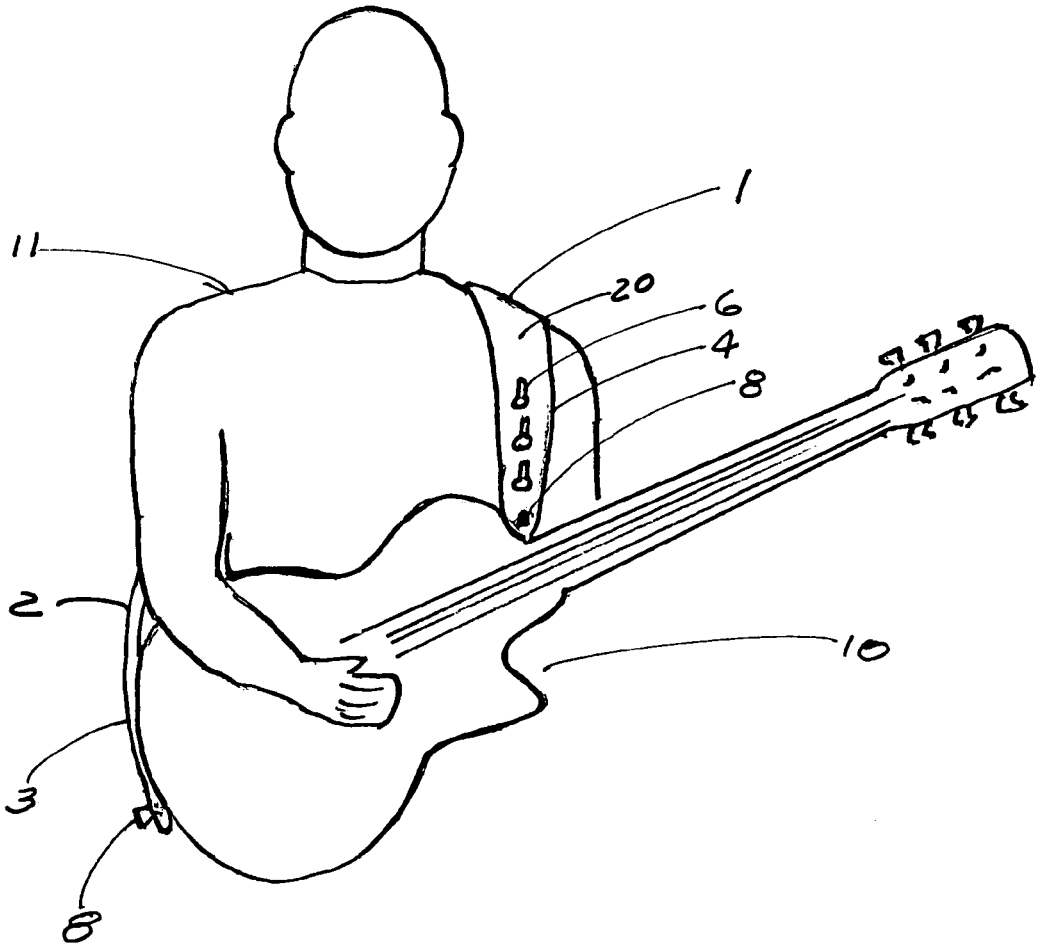
FIG. 1 is a frontal view of a musician with a guitar supported by the invention used as a strap.
Figure 12:
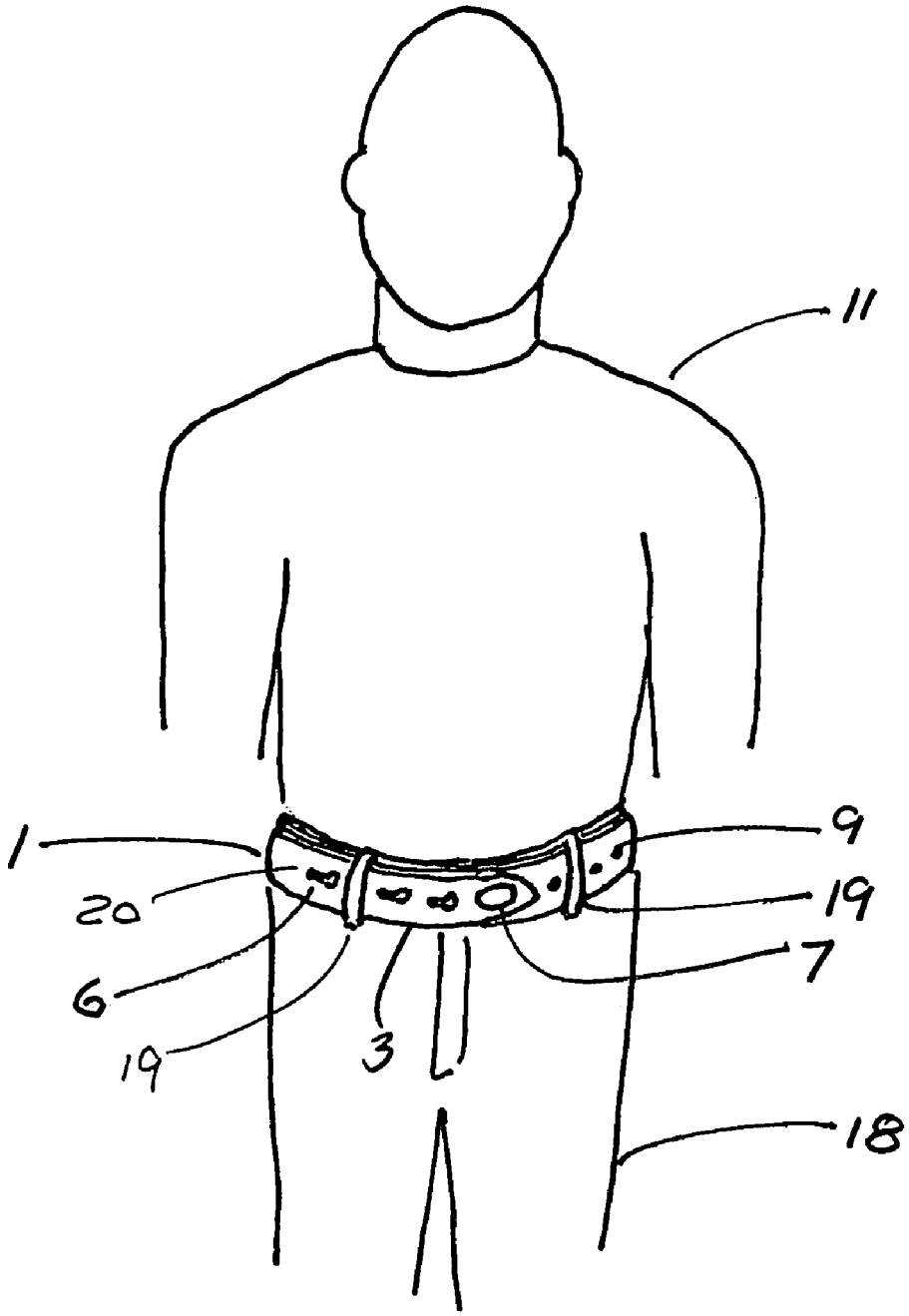
FIG. 12 is a frontal view of a musician wearing the invention as a waist belt with the attachment belt hook on the right end.

Referring now to the drawings, FIG. 1 depicts a frontal view of a musician 11 playing a musical instrument 10 such as a guitar. In FIG. 1, the instrument 10 is supported on the shoulder of the musician 11 by the elongated belt 2 of the inventive device 1 being used in one of its interchangeable roles as a strap for a musical instrument. The alternative role of the inventive device 1 is depicted in FIG. 12 which shows a frontal view of a musician 11 wearing the device 1 as a waist belt to support his pants 18 through belt loops 19.

As depicted in FIG. 1, a musical instrument 10 such as a guitar which is meant to be played while standing is usually equipped with strap buttons 8 at each end of the body of the instrument 10 for attachment to a support strap worn over the shoulder of the musician 11. Strap buttons 8 are a common item on string instruments and usually installed at both ends of an instrument with screws so as to balance the position and weight of the instrument on a shoulder strap to aid the musician in playing and carrying the instrument during the course of a performance. The typical strap button 8 resembles a peg with an enlarged head meant to be inserted into integral strap apertures 6 on both ends of the strap. It is also typical that an instrument strap would have more than one integral strap aperture 6 on at least one end of the strap to allow for adjustment by the musician to suit the reach required. Typically, the integral strap apertures 6 would be slotted in a fashion very similar to a button hole on a garment such that the head of the strap button 8 would have to enter or exit the integral strap aperture in a sideways fashion but would not pull out when in normal use.

Straps for musical instruments are available in a variety of flexible materials such as leather and fabrics both synthetic and natural as well as exotic skins. Such straps are also available in various colors and designs with personal embellishments to suit the individual owner. It is intended that the present invention be available with such variation in material and design as any single purpose instrument strap.

In FIG. 1, the outer surface 20 of the elongated belt 2 is shown as the exposed side which would be suitable for individualized ornamentation. In the use shown in FIG. 1, the right end 3 of the elongated belt 2 is shown as supporting the lower part of the instrument 10, while the left end 4 of the elongated belt 2 is shown as supporting the upper part of the instrument 10, but it is understood, that this arrangement can be switched to suit the musician 11 and also to adapt from right-hand to left-hand playing.

Figure 2:
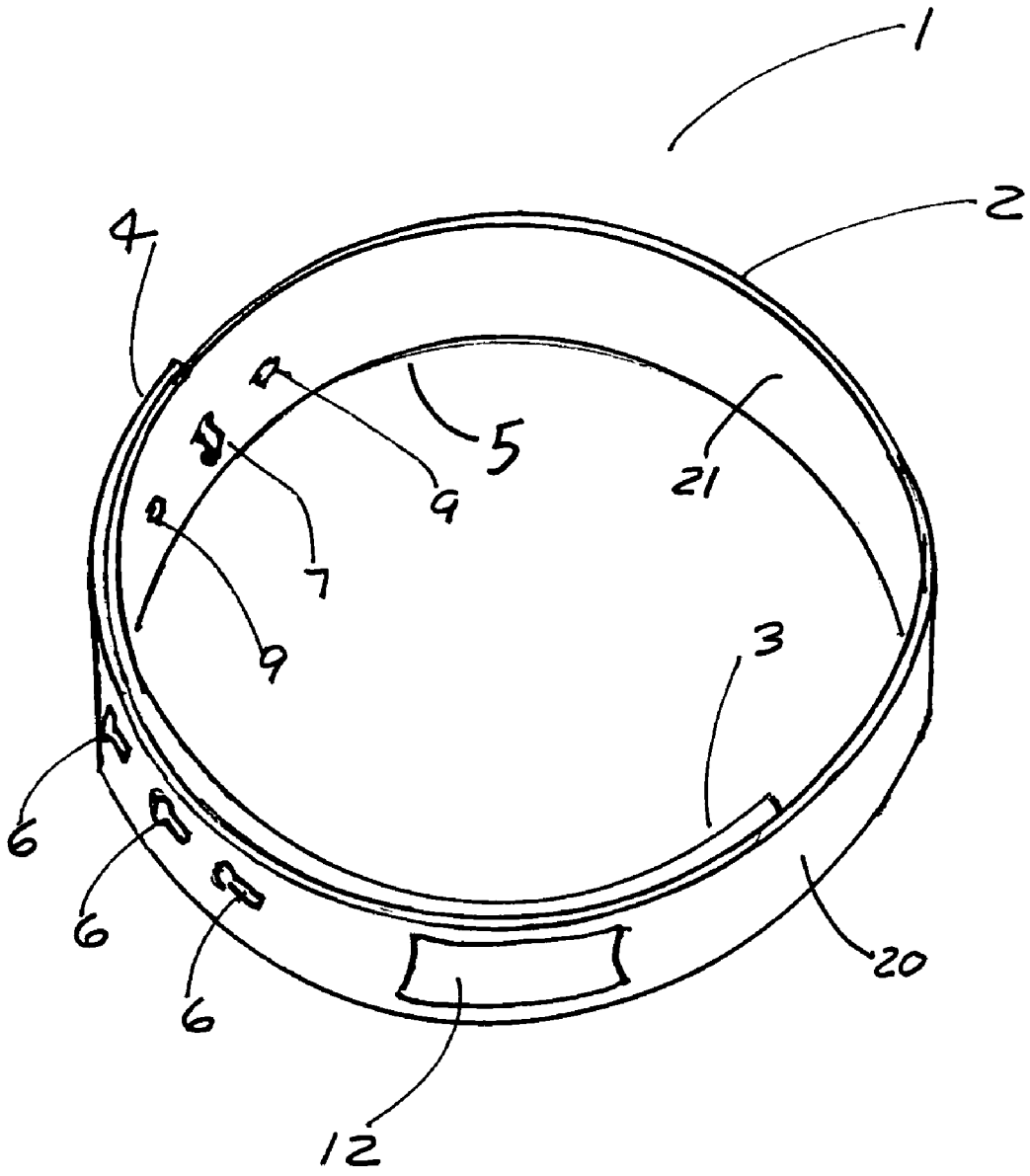
FIG. 2 is a perspective view of the invention as it would be worn as a waist belt with the attachment belt hook on the left end.

FIG. 2 depicts a perspective view of the inventive device 1 as it would be worn in one of its interchangeable roles as a waist belt. In this embodiment an attachment belt hook 7 is fitted to the left end 4 of the elongated belt 2 and shown inserted in one of several integral belt apertures 9 located in the middle portion 5 of the elongated belt 2. The selection of an integral belt aperture 9 will depend on the Waist size of the wearer. In this embodiment the right end 3 of the elongated belt 2 will loop behind the left end 4 of the elongated belt 2 and the outer surface 20 at the right end 3 will be adjacent to the inner surface 21 at the left end 4. An embossed logo 12 may be affixed to or etched on the outer surface 20 between the integral strap apertures 6 on the left end 4 and the integral belt apertures 9 such that the logo 12 will be visible from the front while the device 1 is being worn as a waist belt. In this embodiment, the integral strap apertures 6 on the right end 3 will not be visible. It is intended that the elongated belt 2 be slipped through belt loops 19 in pants 18 similar to those shown in FIG. 12.

Figure 3:
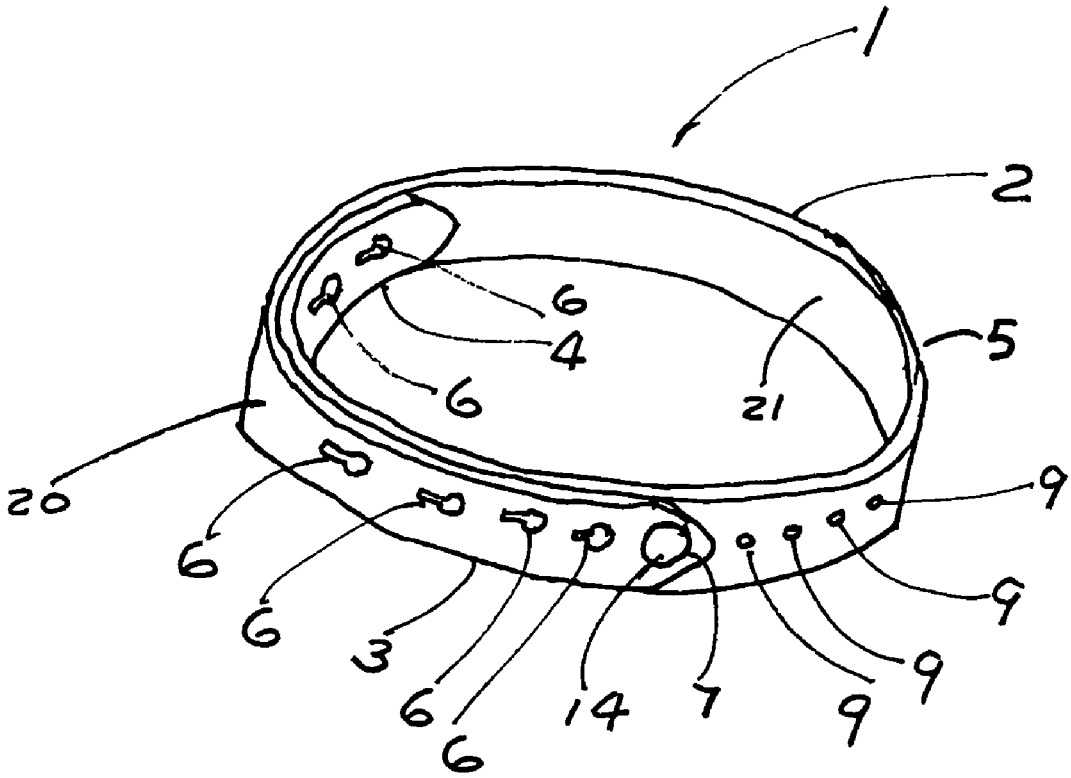
FIG. 3 is a perspective view of the invention as it would be worn as a waist belt with the attachment belt hook on the right end.

FIG. 3 also depicts a perspective view of the inventive device 1 as it would be worn in one of its interchangeable roles as a waist belt. In this alternative embodiment an attachment belt hook 7 is fitted to the right end 3 of the elongated belt 2 and shown inserted in one of several integral belt apertures 9 located in the middle portion 5 of the elongated belt 2. The selection of an integral belt aperture 9 will depend on the waist size of the wearer. In this embodiment the left end 4 of the elongated belt 2 will loop behind the right end 3 of the elongated belt 2 and the outer surface 20 at the left end 4 will be adjacent to the inner surface 21 at the right end 3. In this embodiment, the integral strap apertures 6 on the left end 4 will not be visible. It is also intended in this embodiment that the elongated belt 2 will be slipped through belt loops 19 in pants 18 similar to those shown in FIG. 12. Also depicted in FIG. 3 is an enlarged belt hook head 14 on the attachment belt hook 7. This belt hook head 14 is suitable for the placement of an emblem or other ornamentation.

Figure 4:
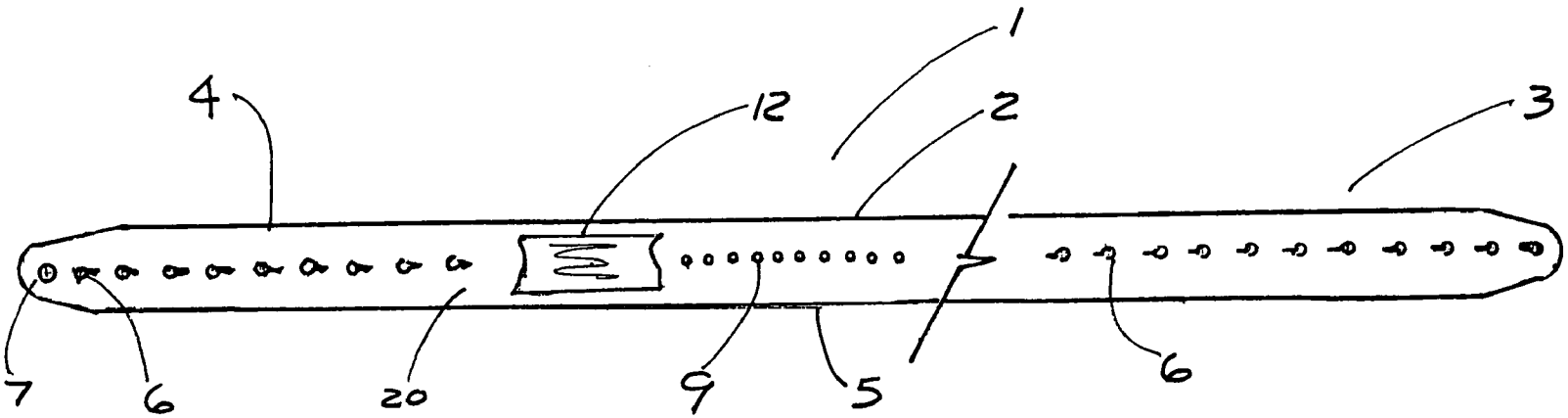
FIG. 4 is a plan view of one embodiment of the invention with the attachment belt hook on the left end, integral strap apertures on the right and left end and integral belt apertures on the middle portion.

FIG. 4 is a plan view of the invention 1 with the elongated belt 2 laying flat with the outer surface 20 exposed. In this figure are depicted the right end 3, the left end 4 and the middle portion 5 as well as the integral strap apertures 6 at both the right end 3 and the left end 4, along with the integral belt apertures 9 in the middle portion 5. FIG. 4 also depicts an attachment belt hook 6 at the left end 4, which would correspond to the waist belt alternative use shown in FIG. 2, but the belt hook 6 can also be fitted to the right end 3 for use as a waist belt as depicted in FIG. 3. Also shown in FIG. 4 is an embossed logo 12 on the outer surface 12 as depicted in FIG. 2.

In order to serve its alternative role as a strap for a musical instrument, the elongated belt 2 of the invention 1 would normally be approximately 60 inches long from end to end. The first integral belt aperture 9 would normally be approximately 30 inches from the end of the elongated belt 2 fitted with an attachment belt hook 7. The integral belt apertures 9 would then be spaced approximately 1 inch apart thereby giving adjustment for waist sizes beginning at 30 inches and proceeding upward in increments of one inch for as many integral belt apertures 9 are made in the middle portion 5 of the elongated belt. While FIG. 4 depicts ten integral belt apertures 9, this is only illustrative and is not a requirement of the invention. Such integral belt apertures 9 would typically be 3/16 of an inch in diameter and extend through the elongated belt from the outer surface 20 to the inner surface 21. The elongated belt 2 would typically be between 1 inch and 1½ inch wide and the thickness of the elongated belt 2 would depend on the material used which could be of various types, including leather, natural fabric, synthetic fabric, and exotic skins to name a few. A typical cowhide leather belt could be 3/16 of an inch in thickness, for example. Any material used for the elongated belt 2 would have to be flexible in nature in order to loop around the waist of a wearer when used as a waist belt and bend over the shoulders of a musician when used to support a musical instrument.

FIG. 4 also depicts a plurality of integral strap apertures 6 on both the right end 3 and the left end 4. The integral strap apertures 6 are intended to engage attachment means on either end of a musical instrument and allow the elongated belt 2 to serve as a shoulder strap for the instrument. The integral strap apertures are typically spaced approximately 2 inches apart to allow for adjustment. While FIG. 4 depicts a plurality of integral strap apertures 6 on both ends, it is possible that only one end will have a plurality of integral strap apertures 6 and the other end will have a single integral strap aperture 6.

Figures 5, 6, 7:
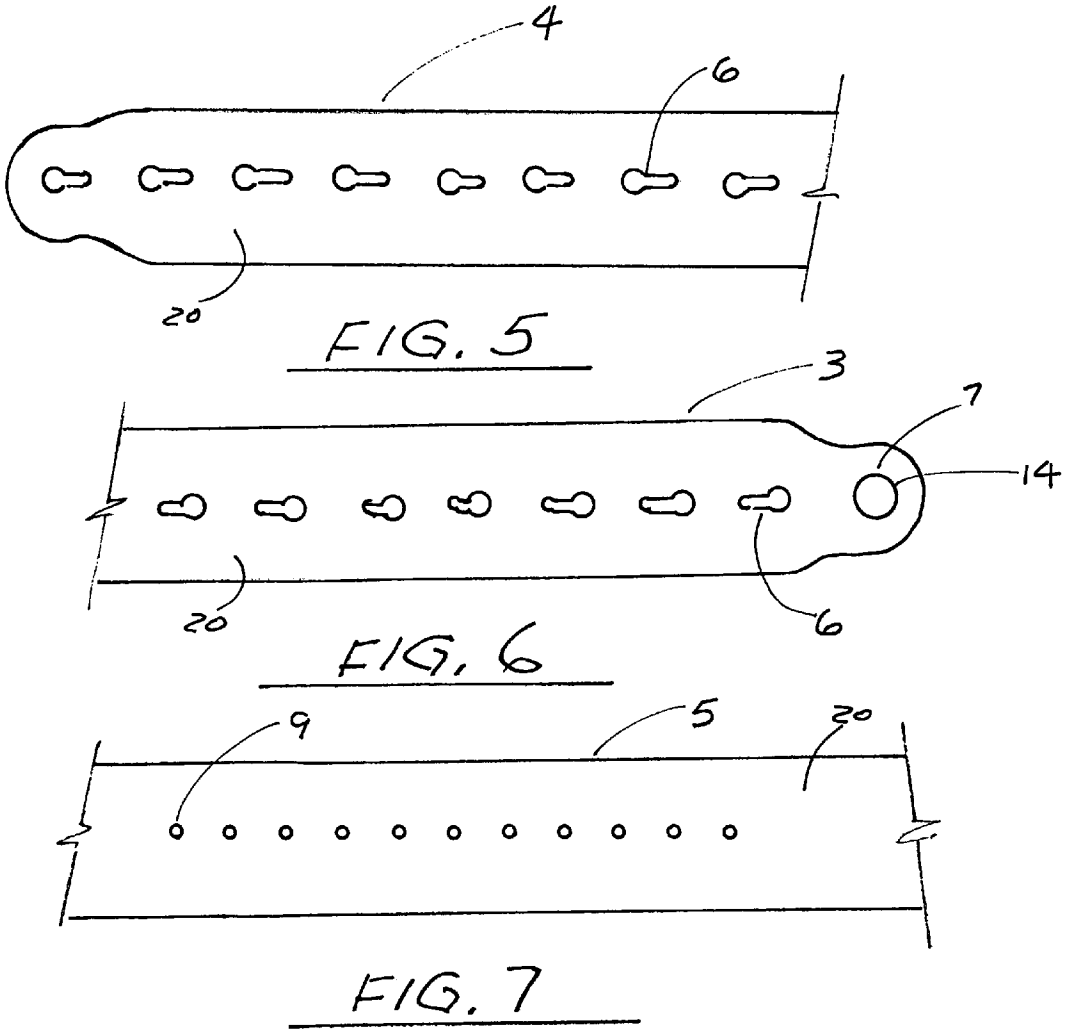
FIG. 5 is an expanded plan view of the left end of the invention with integral strap apertures.
FIG. 6 is an expanded plan view of the right end of the invention with integral strap apertures and attachment belt hook.
FIG. 7 is an expanded plan view of the middle portion of the invention with integral belt apertures.

FIG. 5 is an expanded plan view of the left end 4 of the elongated belt 2 of the invention 1 showing the outer surface 20 and a plurality of integral strap apertures 6. The strap apertures 6, which are meant to engage a strap button 8 on a musical instrument are typically made in a "keyhole" pattern and extend through the elongated belt from the outer surface 20 to the inner surface 21. The large opening at one end of an integral strap aperture 6 would typically be ⅜ of an inch in diameter with the slotted portion approximately ½ inch in length and 3/16 inch wide.

FIG. 6 is an expanded plan view of the right end 3 of the elongated belt 2 of the invention 1 showing the outer surface 20 and a plurality of integral strap apertures 6 similar to those depicted in FIG. 5. FIG. 6 also depicts the placement of an attachment belt hook 7 with a belt hook head 14 on the right end 3. This is the same arrangement depicted in FIG. 3 and FIG. 12 where the invention 1 is being used as a waist belt.

FIG. 7 is an expanded plan view of the middle portion 5 of the elongated belt 2 of the invention 1 showing the outer surface 20 and a plurality of integral belt apertures 9 for engagement with the attachment belt hook 7 when the invention 1 is used as a waist belt. As previously noted such integral belt apertures 9 would typically be 3/16 of an inch in diameter and extend through the elongated belt from the outer surface 20 to the inner surface 21 and be spaced approximately 1 inch apart.

Figure 8:
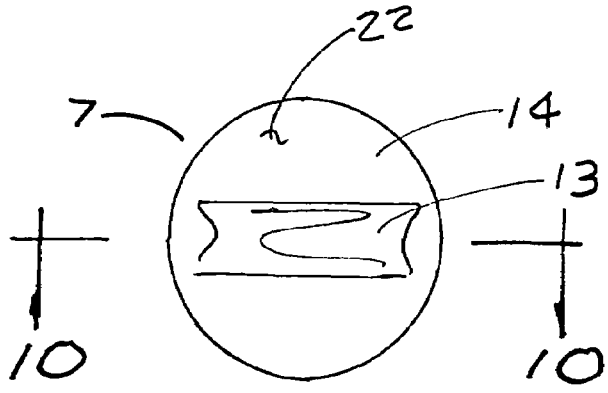
FIG. 8 is a top view of the attachment belt hook head with emblem.

FIG. 8 depicts a top view of one embodiment of an attachment belt hook 7 showing the belt hook head 14, the belt hook head top surface 22 and a belt hook emblem 13 which could be attached or embossed on the belt hook head top surface 22. This embodiment of an attachment belt hook 7 is the same as generally depicted in FIG. 3, FIG. 6 and FIG. 12 where the invention 1 is being used as a waist belt and the attachment belt hook 7 is affixed to the right end 3 of the elongated belt 2. However, the same effect could be derived by affixing the attachment belt hook 7 to the left end 4 and looping the elongated belt 2 from the opposite direction. In this arrangement the belt hook head 14 would be in the front and clearly visible while wearing the invention 1 as a waist belt, while in the arrangement depicted in FIG. 2, the embossed logo 12 would be in the front and clearly visible while the attachment belt hook 7 would be on the side and not intended as a point of ornamentation. In the arrangement shown in FIG. 2, the attachment belt hook 7 would not necessarily need an enlarged belt hook head 14.

Figure 9:
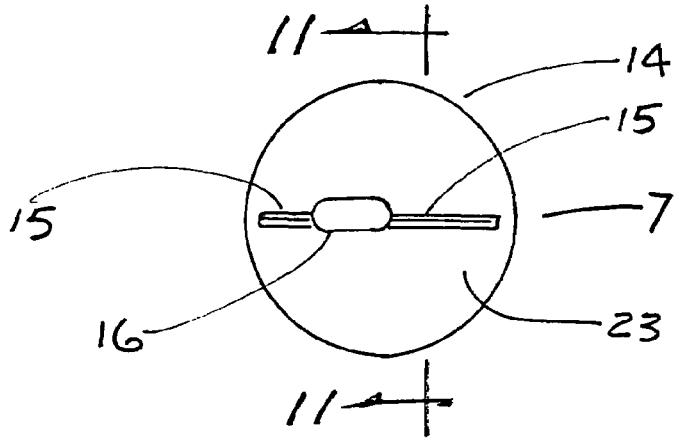
FIG. 9 is a bottom view of the attachment belt hook.

FIG. 9 is a bottom view of the attachment belt hook 7 depicting the belt hook head 14, the belt hook head bottom surface 23, belt hook locking tabs 15 and belt hook shank 16.

Figure 10:
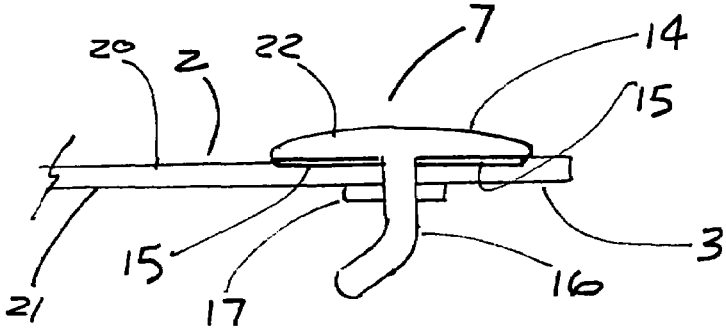
FIG. 10 is a longitudinal sectional view of the attachment belt hook installed in the right end of the invention.

FIG. 10 is a cross sectional view of the attachment belt hook 7 installed in the right end 3 of the elongated belt 2 with such view along the longitudinal axis of the elongated belt 2 and through the elongated belt 2 between the inner surface 21 and the outer surface 20. As depicted in FIG. 10, the belt hook locking tabs 15 impinge the outer surface 20 and the belt hook bottom surface 23 contacts the outer surface 20 while the belt hook shank 16 extends from the belt hook bottom surface 23 through the elongated belt 2 from the outer surface 20 through and past the inner surface 21. The belt hook shank 16 is bent at a point along its axis in a direction away from the end of the elongated belt 2. A belt hook locking washer 17 is drawn coaxially over the belt hook shank 16 to the inner surface and serves to clamp the attachment belt hook 7 to the elongated belt 2 by drawing the belt hook locking tabs into the outer surface 20 and the belt hook head bottom surface 23 tightly against the outer surface 20. In this way, the attachment belt hook 7 is prevented from turning about the axis of the belt hook shank 16 and orienting the belt hook shank 16 in a direction which would prevent its efficacy as a belt hook. The belt hook shank 16 would normally be of cylindrical cross section with a rounded end and be of a diameter matched to the diameter of the integral belt apertures 9 to allow engagement of the belt hook shank 16 in one of the integral belt apertures 9 when the invention 1 is worn as a waist belt. The belt hook shank 16 is bent along its longitudinal axis to create a hook shape to prevent the attachment belt hook 7 from disengaging while the invention 1 is being worn as a waist belt.

Figure 11:
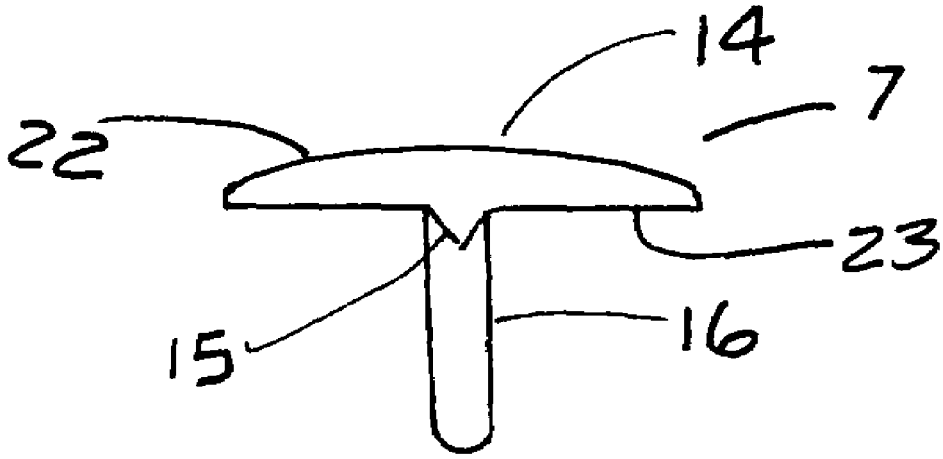
FIG. 11 is a transverse sectional view of the attachment belt hook showing a cross section of the locking tabs.

FIG. 11 is a cross sectional view of the attachment belt hook 7 with the view transverse to the longitudinal axis of the elongated belt 2 as the attachment belt hook 7 would be placed on the elongated belt 2 showing a cross section of the locking tabs 15 which have a knife edge meant to impinge on the outer surface 20 of the elongated belt 2 to prevent rotation of the attachment belt hook 7. Also shown in FIG. 11 is the belt hook head 14, the belt hook head top surface 22, the belt hook head bottom surface 23 and the belt hook shank 16.

The attachment belt hook 7 can be manufactured with a non-metallic material such as plastic in order to eliminate the possibility of scratching the surface of a musical instrument when the invention 1 is serving as a strap for the musical instrument. It is also intended that the attachment belt hook 7 be integrally manufactured as one piece by casting or injection molding of a suitable non-metallic material. A belt hook emblem 13 could also be integrally manufactured with the belt hook head 14 on the belt hook head top surface 22 as part of the manufacture of the attachment belt hook 7

FIG. 12 shows a frontal view of a musician 11 wearing the device 1 as a waist belt to support his pants 18 through belt loops 19 in the arrangement depicted in FIG. 3 with the attachment belt hook 7 on the right end 3 of the elongated belt 2.

The invention claimed is:

1. A combination garment waist belt and musical instrument strap device comprising an elongated flexible belt having a right end, a left end, a middle portion, an outer surface, and an inner surface, said right end and left end each having attachment means for attachment to a musical instrument, one of said ends having an attachment belt hook, said middle portion having receiving means for through placement of said belt hook when said device is worn as a garment waist belt.

2. A device according to claim 1, where the attachment means further comprises at least one integral strap aperture extending between the outer surface and inner surface for attachment to a musical instrument fitted with strap buttons.

3. A device according to claim 2, where the receiving means further comprises at least one integral belt aperture extending between the outer surface and inner surface for selective through insertion of the belt hook when said device is worn as a garment waist belt.

4. A device according to claim 1, where the receiving means further comprises at least one integral belt aperture extending between the outer surface and inner surface for selective through insertion of the belt hook when said device is worn as a garment waist belt.

5. A device according to claim 1, where the attachment belt hook on one of said ends further comprises a head with a top head surface and a bottom head surface, said bottom head surface adjacent to the outer surface, at least one locking tab on bottom head surface, said locking tab impinging on the outer surface, a shank attached to the bottom head surface and extending from the bottom head surface through the elongated flexible belt and extending beyond the bottom surface, and a retaining washer over the shank at the inner surface.

6. A device according to claim 5, where the shank is bent in a direction away from the end of the elongated flexible belt where said attachment belt hook is affixed.

7. A device according to claim 6, where said head and shank are integrally manufactured of non-metallic material.

8. A device according to claim 5, where the attachment belt hook further comprises a non-metallic material.

9. A device according to claim 5, where said head and shank are integrally manufactured of non-metallic material.

10. A method for manufacturing a combination garment waist belt and musical instrument strap device, comprising the steps of;

(a) providing an elongated flexible belt having a right end, a left end, a middle portion, an outer surface and an inner surface;

(b) providing attachment means at the right end and left end for attachment to a musical instrument;

(c) providing an attachment belt hook at one of said ends; and (d) providing receiving means in the middle portion for through placement of the attachment belt hook when the device is worn as a garment waist belt.

11. The method of claim 10 further comprising the step of providing attachment means at each end comprising at least one integral strap aperture extending between the outer surface and inner surface for attachment to a musical instrument fitted with strap buttons.

12. The method of claim 11 further comprising the step of providing receiving means in the middle portion comprising at least one integral belt aperture extending between the outer surface and inner surface for selective through insertion of the belt hook when said device is worn as a garment waist belt.

13. The method of claim 10 further comprising the step of providing receiving means in the middle portion comprising at least one integral belt aperture extending between the outer surface and inner surface for selective through insertion of the belt hook when said device is worn as a garment waist belt.

14. The method of claim 10 further comprising the step of providing an attachment belt hook at one of the ends wherein the attachment belt hook comprises a head with a top head surface and a bottom bead surface adjacent to the outer surface, at least one locking tab on bottom head surface, said locking tab impinging on the outer surface, a shank attached to the bottom bead surface and extending from the bottom head surface through the elongated flexible belt and extending beyond the bottom surface, and a retaining washer over the shank at the inner surface.

15. The method of claim 14 further comprising the step of providing an attachment belt hook where the shank is bent in a direction away from the flexible belt where said attachment belt hook is affixed.

16. The method of claim 15 further comprising the step of providing an attachment belt hook with head and shank integrally manufactured of non-metallic material.

17. The method of claim 14 further comprising the step of providing an attachment belt hook with head and shank integrally manufactured of non-metallic material.

* * * * *